US005927773A

United States Patent [19]

Larsen et al.

[11] Patent Number: 5,927,773

[45] Date of Patent: Jul. 27, 1999

[54] LATCH ASSEMBLY FOR MOVABLE CLOSURE

[75] Inventors: Marvin L. Larsen; Kevin P. Eschweiler, both of New Hampton, Iowa

[73] Assignee: Tri/Mark Corporation, New Hampton, Iowa

[21] Appl. No.: 08/802,142

[22] Filed: Feb. 19, 1997

[51] Int. Cl.[6] ..... E05C 1/02

[52] U.S. Cl. ..... 292/337; 292/DIG. 31; 70/208

[58] Field of Search ..... 292/337, 192, 292/DIG. 31, 169; 70/208, 210

[56] References Cited

U.S. PATENT DOCUMENTS

| | | | |
|---|---|---|---|
| 3,209,564 | 10/1965 | Pelcin | 70/208 |
| 3,789,550 | 2/1974 | Seiwert | 292/DIG. 31 |
| 4,335,595 | 6/1982 | Swan | 292/DIG. 31 |
| 4,892,338 | 1/1990 | Weinerman | 292/DIG. 31 |
| 4,969,916 | 11/1990 | Weinerman | 70/208 |
| 4,986,576 | 1/1991 | Anderson | 292/DIG. 31 |
| 5,046,340 | 9/1991 | Weinerman | 292/DIG. 31 |
| 5,127,686 | 7/1992 | Gleason | 70/208 |
| 5,299,844 | 4/1994 | Gleason | 292/DIG. 31 |
| 5,360,244 | 11/1994 | Gleason | 292/337 |

*Primary Examiner*—Flemming Saether
*Attorney, Agent, or Firm*—Wood, Phillips, VanSanten, Clark & Mortimer

[57] ABSTRACT

A latch assembly for a movable closure, which latch assembly has a housing having a front and rear and a wall with a forwardly facing surface, and an actuating assembly that is changeable between first and second states. The actuating assembly has an actuator element that is operable to selectively change the actuating assembly from the first state into the second state. The housing wall has an opening therethrough to allow the actuating assembly to extend from forwardly of the housing wall through the housing wall opening to rearwardly of the housing wall and reposition a latch element at the rear of the housing as an incident of the actuating assembly changing from the first state into the second state. The actuating assembly has a wall disposed in front of the housing wall that fully blocks the housing opening as viewed from the front of the housing.

10 Claims, 5 Drawing Sheets

LATCH ASSEMBLY FOR MOVABLE CLOSURE

BACKGROUND OF THE INVENTION

1. Field of the Invention

This invention relates to latch assemblies of the type used to releasably maintain a movable closure in a closed state.

2. Background Art

Paddle-operated latch assemblies are well known in the prior art. One exemplary latch assembly is shown in U.S. Pat. No. 5,042,853, to Gleason et al. This type of latch assembly is useable on closures in a wide range of environments, for example, on recreational vehicles, trailers, motor homes, tool boxes, etc.

In a typical installation, an opening is provided through the closure to accept the latch assembly. The latch assembly extends fully through the opening to either a) an operating linkage to effect locking, as in the case of a tool box, or b) an operating assembly that may include a paddle, on the inside, as in the case of a door on a recreational vehicle. In the latter environment, it is known to provide a cup-shaped housing defining a receptacle within which the external paddle resides and to operatively engage the paddle with a latch element behind the housing through an opening in the housing. Typically, this opening will be provided in a wall having a forwardly facing surface at the base of the cup-shaped receptacle. This opening permits ingress of rain and other foreign material through the front of the latch assembly housing. More particularly, this opening provides an unimpeded path for wind blown rain, dust, and the like, at the front of the latch assembly to between the front and rear walls of the closure and/or to the interior of the space bounded by the movable closure. The ongoing migration of water through this opening may eventually foul the latch mechanism and/or cause damage to the closure, such as rotting or delamination. Significant ingress of water to the interior space bounded by the closure may cause damage to the contents within that space.

To leakproof the connection between the latch assembly and the closure, it is also known to provide a gasket between a peripheral flange on the latch assembly housing and the forwardly facing, external surface on the closure. Some latch housings and flanges have a rectangular shape with the gasket being matched generally to that rectangular shape. However, there is normally a significant amount of play in the connection between the gasket and the housing which allows the gasket to shift. This may result in the gasket being improperly aligned relative to the flange so that at some locations it projects significantly outwardly from the flange so as to be unsightly. In a worst case, the location may be compromised to the point that the integrity of the seal is affected.

Another problem frequently encountered with this type of latch assembly is improper alignment within the closure opening. Normally, a standard opening is provided to accept the latch assembly. The latch assembly housing is allowed to shift slightly to allow a non-interference fit and slight movement to allow centering by the installer. As a result of this, an installation may result wherein the latch assembly is skewed, which may not only detract from its appearance but in a worse case affect proper functioning.

Even if the latch assembly is properly assembled, it may become skewed in use. In some latch assemblies, the holding force is principally that produced between the mounting flange and the closure. In some of the closures, such as those on horse trailers, the latch assemblies may be subjected to severe forces that may shift and skew what was initially a properly assembled latch assembly.

It is well known to make the above type of latch assemblies with a latch element having a metal surface that cams against a metal strike element, on a frame to which the latch assembly mounts, and cooperates with the strike element to maintain the closure in a closed state. The repetitive camming action between the latch element and strike element may eventually lead to the fatigue and failure of the strike element. Aside from the wear problem, a significant amount of noise is developed as metal-to-metal contact occurs, as when the closure is moved between open and closed states.

SUMMARY OF THE INVENTION

In one form of the invention, a latch assembly is provided for a movable closure, which latch assembly has a housing having a front and rear and a wall with a forwardly facing surface, and an actuating assembly that is changeable between first and second states. The actuating assembly has an actuator element that is operable to selectively change the actuating assembly from the first state into the second state. The housing wall has an opening therethrough to allow the actuating assembly to extend from forwardly of the housing wall through the housing wall opening to rearwardly of the housing wall and reposition a latch element at the rear of the housing as an incident of the actuating assembly changing from the first state into the second state. The actuating assembly has a wall disposed in front of the housing wall that fully blocks the housing opening as viewed from the front of the housing.

The actuator element may be a hand operable paddle that is pivotably connected to the housing for movement between first and second positions to change the actuating assembly from the first state into the second state.

The paddle may define the wall on the actuating assembly.

The latch assembly may further include a latch element that is movable between a latched position and a released position, with the actuating assembly causing the latch element to move from the latched position into the released position as an incident of the paddle being moved from the first position into the second position and the actuating assembly being changed from the first state into the second state.

The housing may be defined by a cup-shaped body, with the housing wall being at the rear of the cup-shaped body.

The cup-shaped body has laterally spaced walls and vertically spaced walls bounding a cup-shaped receptacle. The housing wall may be midway between one of a) the laterally spaced walls and b) the vertically spaced walls.

The housing may have first and second spaced, discrete ribs defining first and second spaced edges which are abuttable to an edge on a movable closure to which the latch assembly is operatively mounted.

A gasket may be provided having a projection extending between and interlocked with the first and second ribs to consistently maintain the housing and gasket in a predetermined relative position.

A separate gasket may be provided on at least one of the paddle and housing to fully surround the housing opening to block the passage of water through the housing opening from the front of the housing wall.

In one form, the latch element has a surface for engaging a frame to which a movable closure on which the latch assembly is mounted is movably mounted, with the surface being made at least partially from a plastic material.

The latch assembly may be provided in combination with a movable closure upon which the latch assembly is mounted in an operative position. The closure has a front and rear and a peripheral edge between the front and rear of the closure. The latch assembly has a mounting plate and a fastener extends through the peripheral edge of the closure and into the mounting plate.

The mounting plate may be rigidly attached to the housing and maintains the latch element on the housing and guides movement of the latch element between the latched and released positions.

The invention further contemplates the combination of a) a movable closure mounted to a frame for movement relative to the frame between open and closed positions and b) a latch assembly in an operative position on the movable closure. The movable closure has a front and rear and a peripheral edge between the front and rear. The latch assembly has a housing with a front and rear and a wall with a forwardly facing surface. The housing further has laterally spaced walls and vertically spaced walls, defining in conjunction with the wall with the forwardly facing surface, a forwardly opening cup-shaped receptacle. The latch assembly has an actuating assembly that is changeable between first and second states. The actuating assembly includes an actuator element that is operable to selectively change the actuating assembly from the first state into the second state. The housing wall with the forwardly facing surface has an opening therethrough to allow the actuating assembly to extend from forwardly of the housing wall with the forwardly facing surface through the opening to rearwardly of the housing wall with the forwardly facing surface and reposition a latch element at the rear of the housing as an incident of the actuating assembly changing from the first state into the second state. The opening is located to be midway between both the laterally spaced housing walls and the vertically spaced housing walls. The actuating assembly includes a paddle residing at least partially within the housing receptacle and pivotably connected to the housing for movement between first and second positions to change the actuating assembly from the first state into the second state.

DETAILED DESCRIPTION OF THE DRAWINGS

Figure 1:
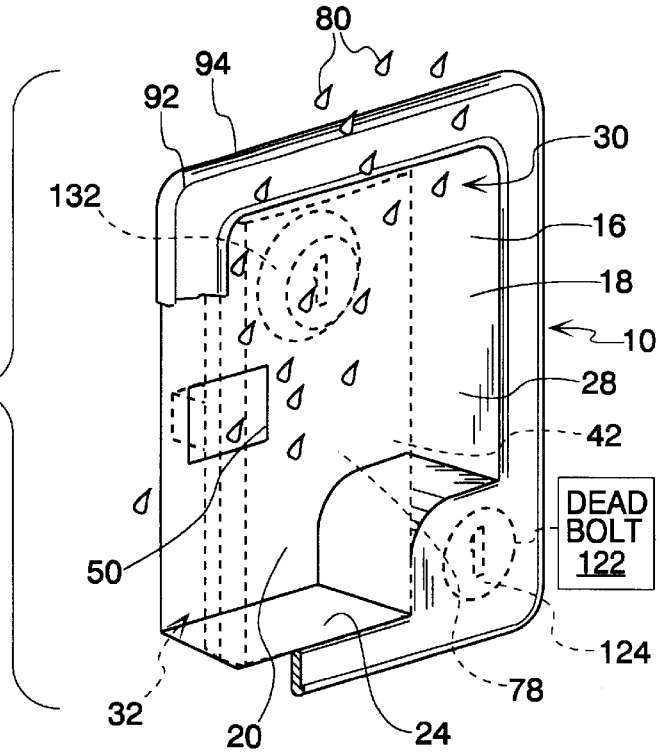
FIG. 1 a fragmentary, front perspective view of a latch assembly for a movable closure, according to the present invention.
Figure 7:
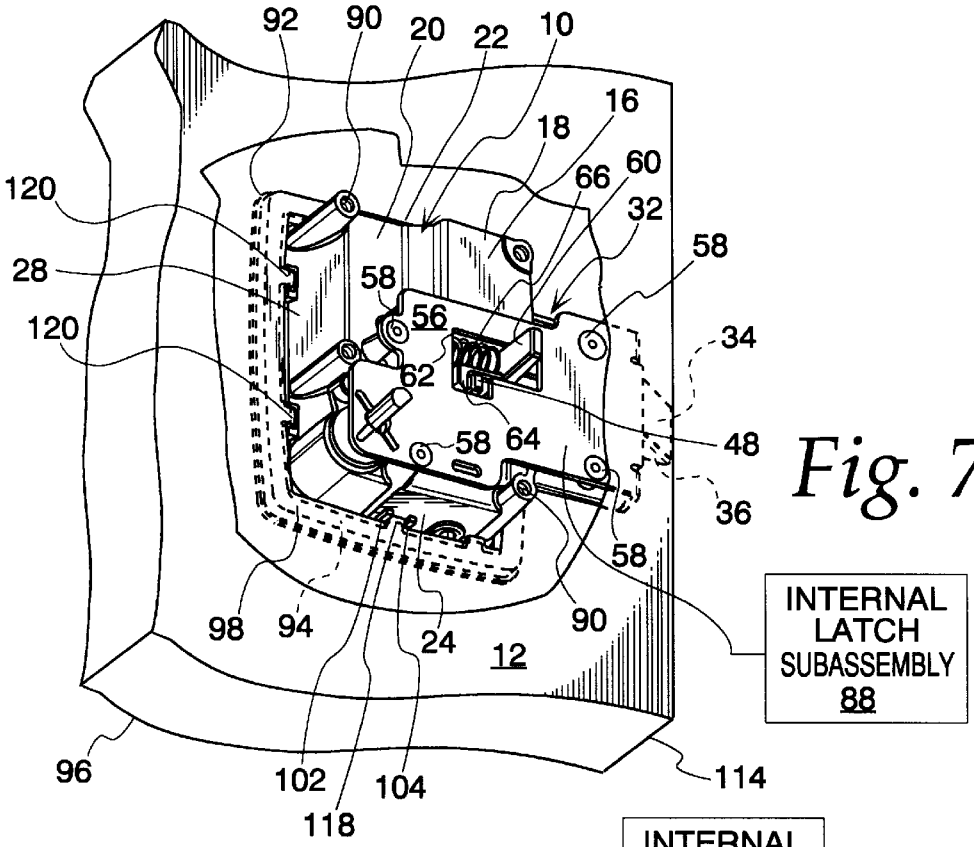
FIG. 7 is a rear perspective view of the inventive latch assembly in an operative position on a closure.
Figure 8:
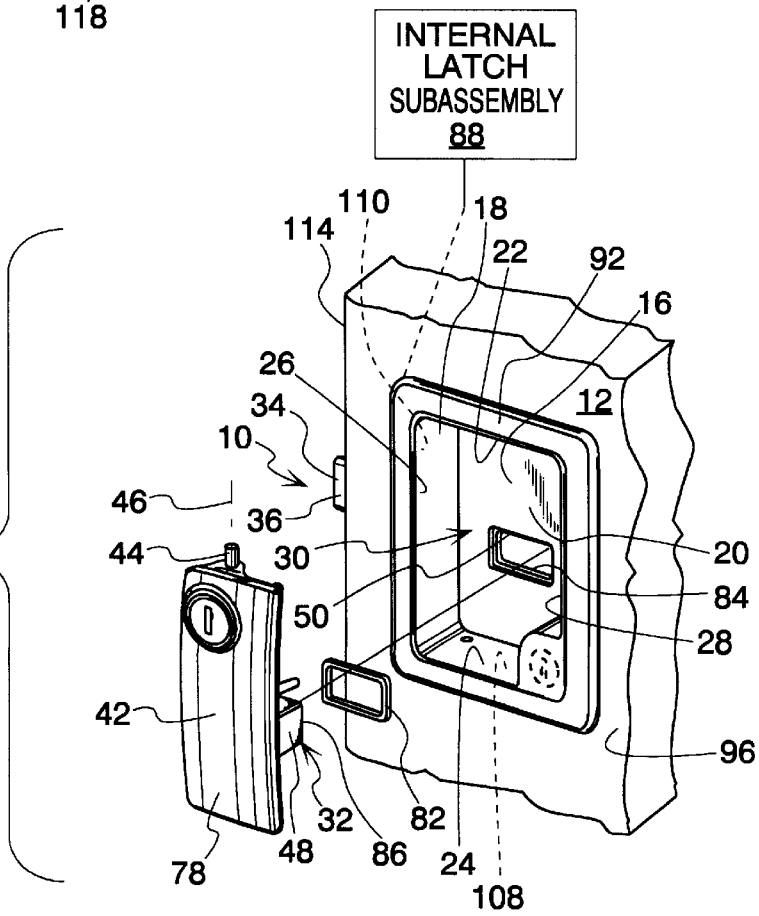
FIG. 8 is a reduced, exploded, front perspective view of the inventive latch assembly in an operative position on a closure.

In FIGS. 1–12, a latch assembly, according to the present invention, is shown at 10. The latch assembly 10 is shown in FIGS. 1, 7 and 8 in an operative position upon a closure 12 that is mounted on a frame 14 for pivoting movement between a closed position, as shown in solid lines in FIG. 2, and an open position, as shown in phantom lines in FIG. 2.

The latch assembly has a housing 16 with a body 18 having a rear wall 20, vertically spaced top and bottom walls 22, 24, and laterally spaced side walls 26, 28, cooperatively defining a forwardly opening cup shape which bounds a receptacle 30.

Figures 9, 10:
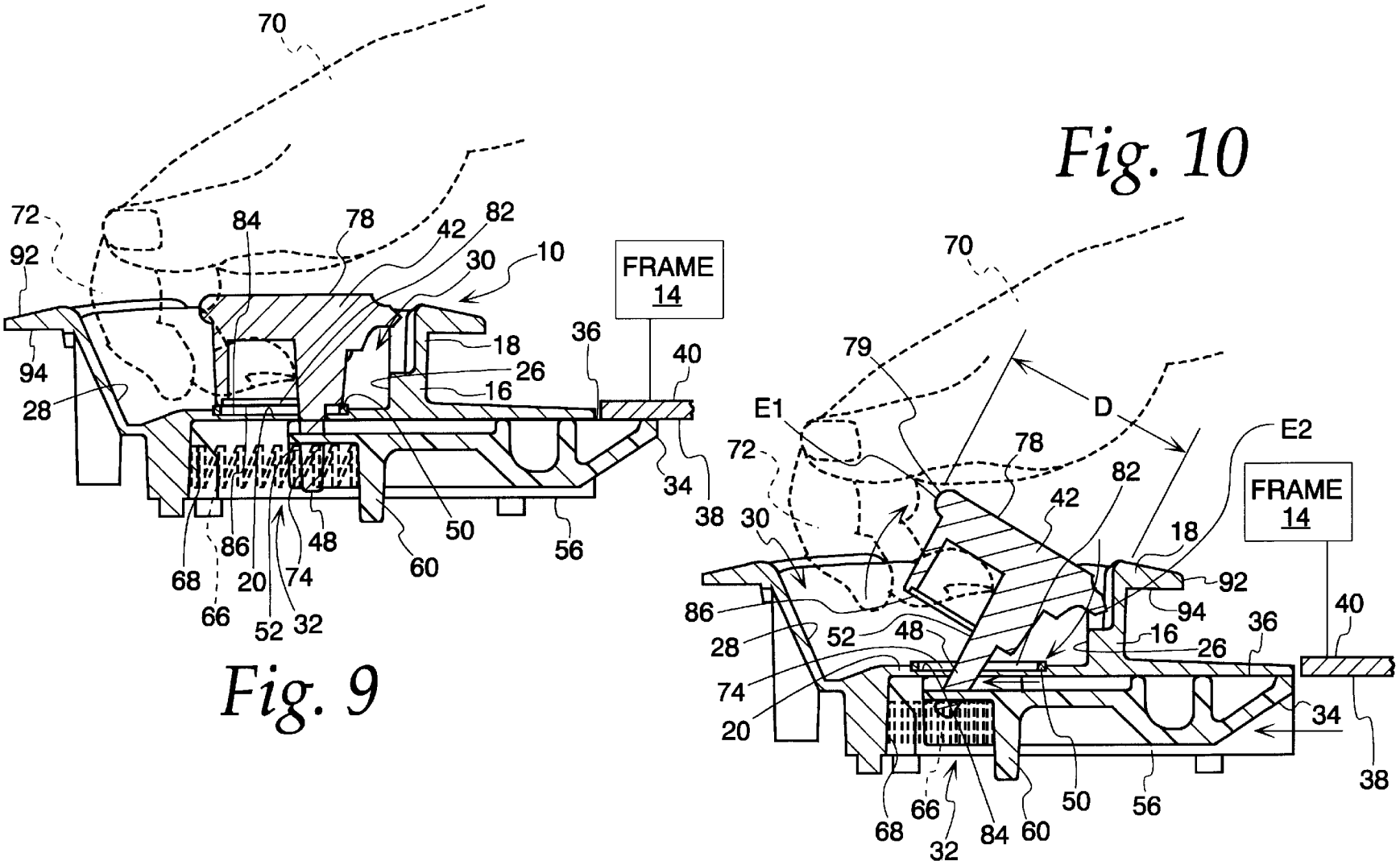
FIG. 9 is a cross-sectional view of the inventive latch assembly in a first state wherein the latch element is in a latched position.
FIG. 10 is a view as in FIG. 9 with the latch assembly in a second state wherein the latch element is in a released position.

An actuating assembly at 32 is operable between a first state, shown in FIG. 9, and a second state, shown in FIG. 10, to selectively reposition a latching element/bolt 34 between a latched position, shown in FIG. 9, and a released position, shown in FIG. 10. With the closure 12 in a closed position and the latching element/bolt 34 in the latched position, a forwardly facing surface 36 on the latching element/bolt 34 resides behind a rearwardly facing surface 38 on a strike element 40 carried on the frame 14, to thereby prevent the closure 12 from being moved from the closed position to the open position therefor. With the latching element/bolt 34 in the retracted position of FIG. 10, the closure 12 is allowed to be moved unimpededly between the open and closed positions therefor.

The actuating assembly 32 includes an actuator element 42 in the form of a paddle that resides within the receptacle 30 and is connected to the housing body 18 through a post 44 for pivoting movement around a vertically extending axis 46. The paddle 42 has a cantilevered actuating arm 48 which projects through a laterally elongated opening/slot 50 in the rear housing wall 20 to engage the latching element/bolt 34. The actuating arm 48 and pivot axis 36 are located so that the laterally facing actuating surface 52 on the actuating arm 48 sweeps in an arcuate path from right to left in FIGS. 1, 2, and 8–10 through the opening/slot 50 between a first position, shown in FIG. 9, and a second position shown in FIG. 10, as a result of which the latching element/bolt 34 is shifted from the latched position to the released position, thereby changing the actuating assembly 32 from the first state into the second state.

A mounting plate 56 is fixedly secured by fasteners 58 to the rear wall 20 of the housing 16 to captively maintain the latching element/bolt 34 in an operative position upon the housing 16 and to cooperate with the housing 16 so as to guide movement of the latching element/bolt 34 between the latched and released positions. The latching element/bolt 34 has a rearwardly projecting guide arm 60 which projects through a guide slot 62 in the mounting plate 56. The guide arm 60 is guided laterally within the slot 62 as the latching element/bolt 34 moves between the latched and released positions. An offset on the latching element/bolt 34 abuts to the paddle arm 48 to limit movement of the latching element/bolt 34 moving towards the latched position, so that the amount of lateral extension of the latching element/bolt 34 beyond the housing 16 with the latching element/bolt 34 in the latched position is predetermined. A coil spring 66 is compressibly captive between the guide arm 60 and a surface 68 on the housing 16 facing the guide arm 60 so that the latching element/bolt 34 is normally biased into the latched position of FIG. 9.

To operate the latch assembly, the user's hand 70 is situated so that the user's fingers 72 can be moved into the receptacle 30 between the housing wall 28 and the paddle 42 to allow the fingers to engage behind the paddle 42. By then drawing the paddle 42 forwardly with the fingers, the paddle 42 is pivoted, causing a surface 74 on the actuating arm 48 to bear on an edge 76 on the latching element/bolt 34 to thereby effect repositioning of the latching element/bolt 34 from the latched position into the retracted position. By releasing the paddle 42, the coil spring 66 is allowed to drive the latching element/bolt 34 back into the latched position. The edge 76 on the latching element/bolt 34 acts against the actuating arm 48 on the paddle 42 to thereby biasably draw the paddle 42 from the second position of FIG. 10 back into the first position of FIG. 9.

The opening/slot 50 is located midway both between the side walls 26, 28 and vertically between the top and bottom walls 22, 24. By "midway" it is meant that the opening/slot 50 is spaced substantially from each of the walls 22, 24, 26, 28. In a preferred form, the opening/slot 50 is substantially centered between the side walls 26, 28, while being slightly below a centered location between the top and bottom walls 22, 24. With this arrangement, the forward wall 78 of the paddle 42 fully blocks the opening/slot 50 as viewed from the front of the latch assembly 10. As seen most clearly in FIGS. 8 and 10, the cantilevered actuating arm 48 projects rearwardly from the wall 78 in a direction generally perpendicular to the wall 78 at a location spaced from a peripheral edge 79 of the wall 78 as viewed from the front of the latch assembly. The peripheral edge 79 has edge portions E1, E2 spaced from each other along a line perpendicular to the axis 46 a first distance D. The actuating arm 48 is spaced from each edge portion E1, E2 a distance at least equal to ¼ of the first distance D. Wind driven rain and other foreign material directed horizontally at the latch assembly 10 will be blocked by the paddle wall 78. This condition is shown schematically for water droplets 80 in FIG. 1.

To provide additional protection against water migration, a gasket 82 is mounted on an undercut seat 84 extending fully around the opening/slot 50. The paddle 42 has an edge 86 which conforms to the seat 84, with the gasket 82 being sandwiched between the edge 86 on the paddle 42 and the seat 84 on the housing body 18. Under the force of the coil spring 66, the paddle 42 is biased to effect a slight compression of the gasket 82 between the seat 84 and edge 86, to produce a more positive seal around the opening/slot 50. A relatively good seal can be effected between the edge 86 and the seat 84 without the need for the gasket 82.

To maintain the latch assembly 10 in the operative position on the closure 12, a captive mounting arrangement is employed. An internal latch subassembly 88 is provided on the inside of the closure 12. The closure 12 is sandwiched between the housing 16 and the internal latch assembly 88. Bolts (not shown) are directed from the internal latch subassembly 88 into threaded bores 90 in the housing body 18. The housing body 18 has a peripheral, outturned flange 92 defining a rearwardly facing surface 94 which is drawn into facially abutting relationship with the forward surface 96 of the closure 12. The sealing gasket 98 is interposed between the rearwardly facing surface 94 on the flange 92 and the forwardly facing surface 96 on the closure 12. With the body 18 and the internal latch assembly 88 drawn positively towards each other, the gasket 98 becomes compressed to produce a watertight seal around the flange 92.

Laterally spaced ribs 100, 102 are provided on the bottom wall 24. The ribs 100, 102 have edges 104, 106 which face downwardly and perform a locating function. That is, the edges 104, 106 bear on an upwardly facing edge 108 on the closure 12 bounding the mounting opening 110 in the closure 12 which accommodates the housing body 18. By placing the edges 104, 106 against the closure edge 108, the vertical location of the housing body 18 within the opening 110 is consistently maintained.

Consistent lateral location of the housing body 18 is established by directing fasteners 112 through the closure edge 114, from which the latching element/bolt 34 projects, through offset tabs 116, formed as one piece with, and bent out of, the mounting plate 56, and into the housing body 18. While this arrangement consistently draws the housing body 18 to the same lateral location, it also stabilizes the housing body 18 in a lateral direction. That is, the captive force between the housing body 18 and internal latch subassembly 88 is augmented by the connection between the closure 12 and the mounting plate 56.

The ribs 100, 102 also perform a locating function for the gasket 98. The gasket 98 has a tab 118, which is configured to reside between the ribs 100, 102 and establishes a consistent location for the gasket 98 with respect to the housing body 18. This arrangement also prevents unwanted shifting between the gasket 98 and the housing body 18. Additional tabs 120 interlock at other locations around the periphery of the housing body 18.

The invention also contemplates that the latching element/bolt 34 can be made from a plastic material, such as nylon. It is common to make the latching element/bolt 34 of metal such as zinc. Repetitive door closing and contacts between the metal latching element/bolt 34 and metal strike element 40 can lead to fatigue and failure of the strike element 40. By making the latching element/bolt 34 from plastic, the metal-to-metal contact is avoided between the latching element/bolt 34 and the strike element 40 to thereby reduce noise and avoid wear. While the entire latching element/bolt 34 can be made from plastic, the latching element/bolt 34 can have a composite construction of plastic and another material, with the plastic being strategically located on those surfaces which contact the strike element 40.

Figure 2:
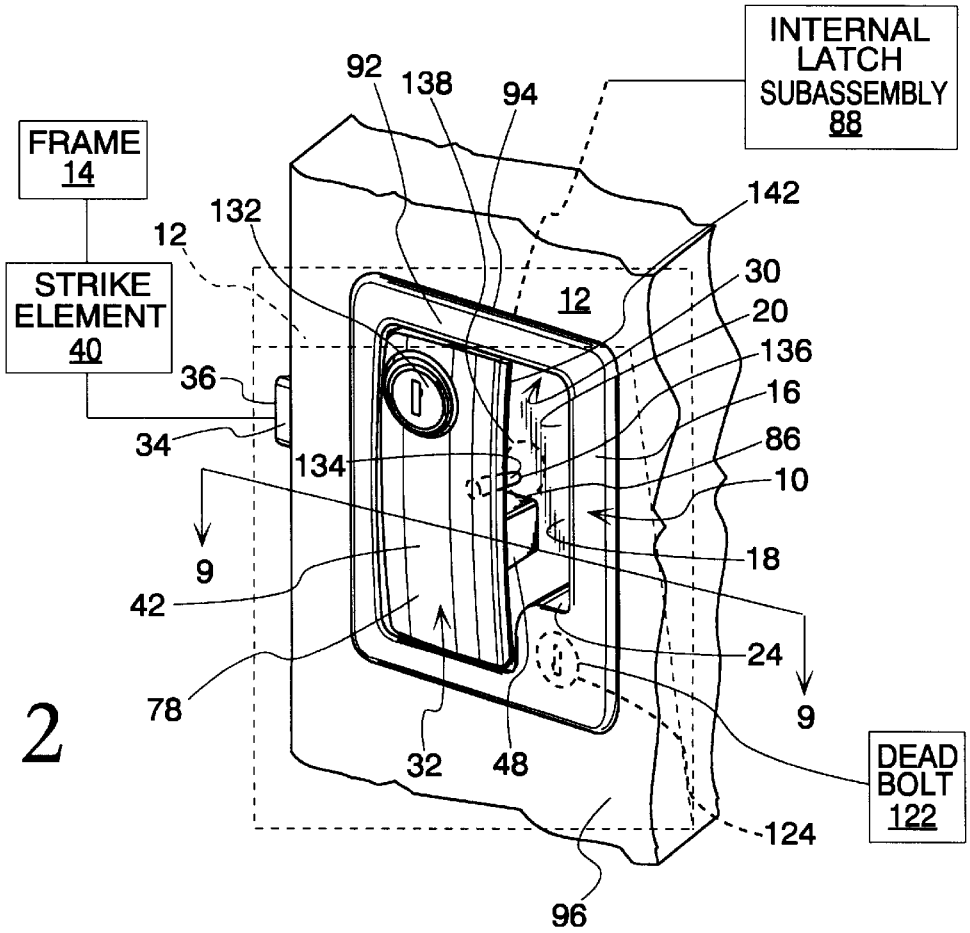
FIG. 2 is a front perspective view of the inventive latch assembly in an operative position a movable closure.
Figure 3:
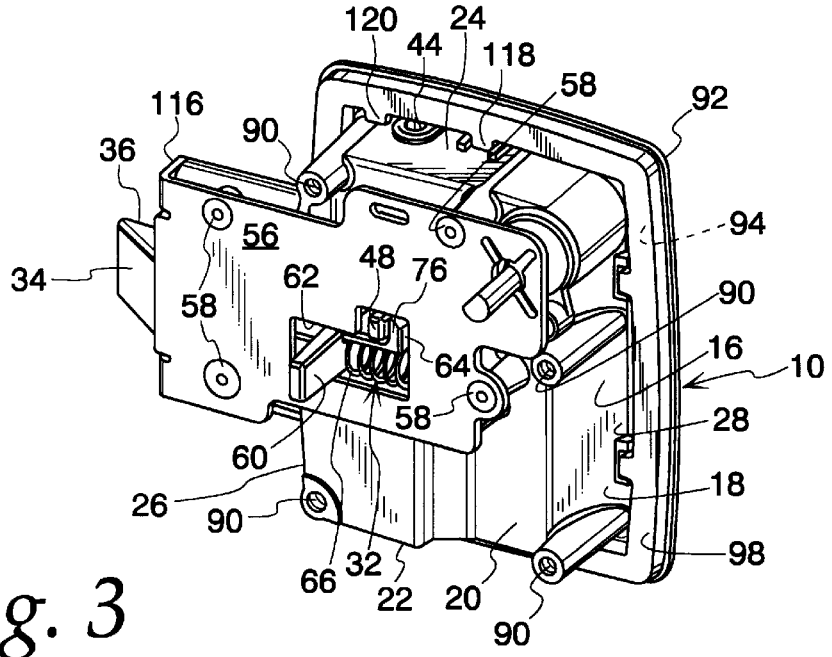
FIG. 3 is a rear perspective view of the inventive latch assembly.
Figure 4:
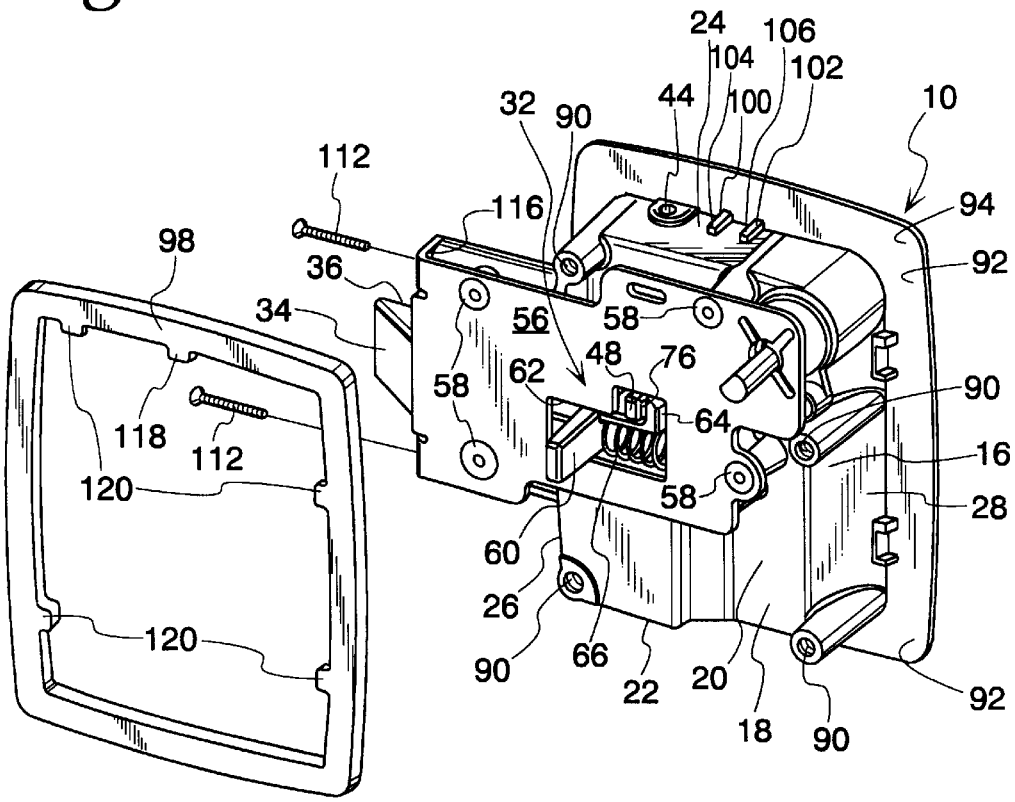
FIG. 4 is an exploded, rear perspective view of the inventive latch assembly.
Figure 5:
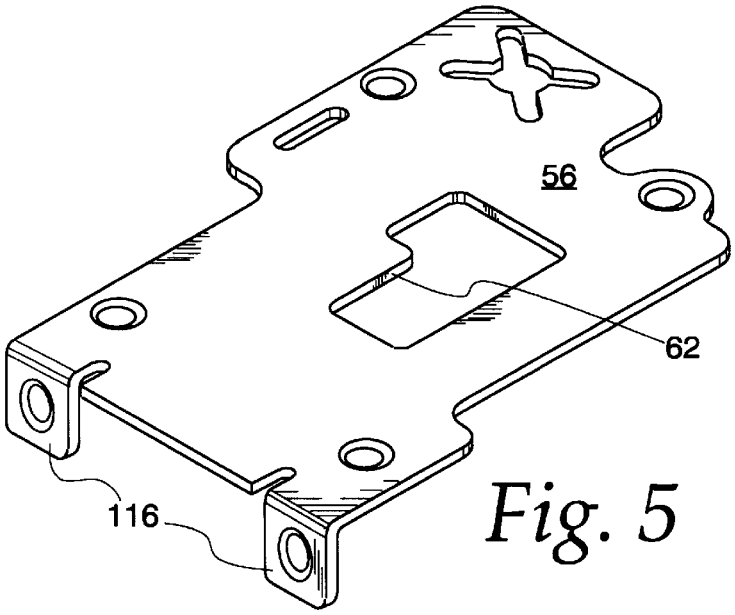
FIG. 5 is an enlarged, rear perspective view of a mounting plate on the inventive latch assembly.
Figure 6:
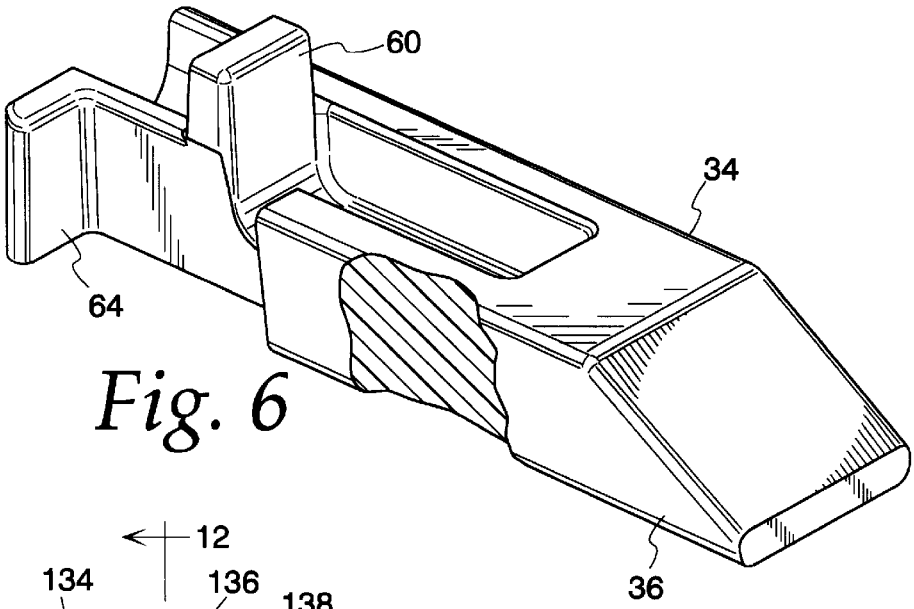
FIG. 6 is an enlarged, perspective view of a latching element on the inventive latch assembly.

The latch assembly 10 can be made with or without a deadbolt feature. In FIGS. 1 and 2, a deadbolt 122 is shown schematically and is operable through a keyed cylinder 124.

Figure 11:
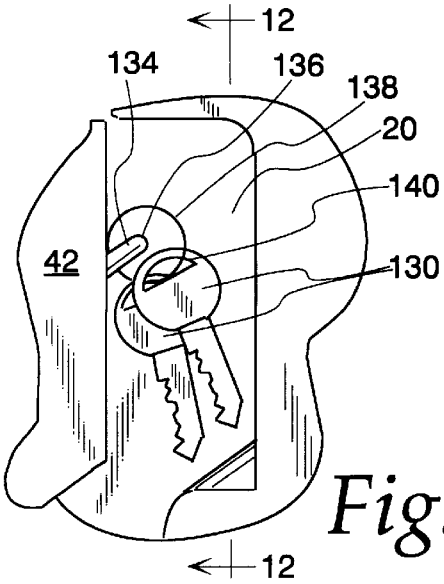
FIG. 11 is a fragmentary, front elevation view of the inventive latch assembly showing operating keys therefor mounted in a storage position.
Figure 12:
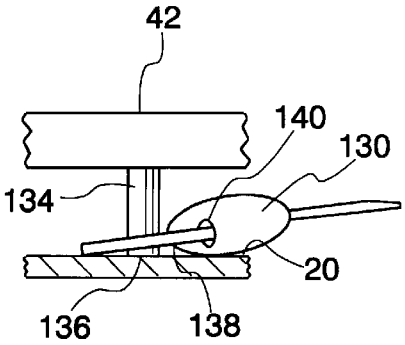
FIG. 12 is a fragmentary, cross-sectional view of the inventive latch assembly taken along lines 12—12 of FIG. 11.

The paddle 42 and housing 16 cooperate to allow a set of operating keys 130 for the deadbolt 122 and a paddle lock 132 to be maintained conveniently on the latch assembly 10 for shipping. As shown in FIGS. 2, 11 and 12, the paddle 42 has a rearwardly projecting post 134 with a free end 136 that abuts to the housing wall 20 with the paddle 42 in the first position of FIGS. 1, 2 and 9. Typically, a pair of the keys 130 are maintained together by a wire ring 138 which extends through an opening 140 in each key 130. By pivoting the paddle 42 towards the second position of FIG. 10, the key ring 138 can be placed around the post 134. By then releasing the paddle 42, the free end 136 of the post 134 is allowed to abut to the wall 20. Through this arrangement, the post 134 maintains the ring 138 in the receptacle 30. The keys 130 are accommodated by the space between the edge 142 of the paddle 42 and the wall 28 so that the keys 130 do not protrude significantly forwardly beyond the wall 78 of the paddle 42.

The foregoing disclosure of specific embodiments is intended to be illustrative of the broad concepts comprehended by the invention.

I claim:

1. A latch assembly for a movable closure, the latch assembly comprising:

a housing having a front, a rear, and a wall with a forwardly facing surface; and an actuating assembly that is changeable between first and second states, the actuating assembly including an actuator element that is operable to selectively change the actuating assembly from the first state into the second state, the housing wall having an opening therethrough to allow the actuating assembly to extend from forwardly of the housing wall through the housing wall opening to rearwardly of the housing wall and reposition a latch element at the rear of the housing as an incident of the actuating assembly changing from the first state into the second state, the actuating assembly comprising a first wall disposed in front of the housing wall that fully blocks the housing opening as viewed from the front of the housing, wherein the actuator element comprises a hand operable paddle that is pivotably connected to the housing for movement around an axis between first and second positions to change the actuating assembly from the first state into the second state, wherein the paddle defines the first wall and has a peripheral edge as viewed from the front of the latch assembly and spaced edge portions spaced from each other by a first distance along a line that is substantially orthogonal to the axis, the first wall having a rearwardly facing surface, said actuator element comprising a cantilevered post which projects rearwardly from the first wall at a location spaced from each of the edge portions by a distance at least equal to ¼ of said first distance, the cantilevered post being oriented to project in a direction generally perpendicular to the first wall, there being a space between the peripheral edge of the paddle and the housing so that fingers on a user's hand can move rearwardly into the space and engage the rearwardly facing surface on the first wall to draw a part of the paddle forwardly to pivot the paddle from the first position into the second position, said cantileverd post being fixedly connected to the first wall, said latch assembly further comprising a latch element that is movable between a latched position and a released position, said cantilevered post driving the latch element from one of the latched and released positions into the other of the latched and released positions as an incident of the paddle moving from the first position into the second position.

2. The latch assembly according to claim 1 wherein the housing comprises a forwardly opening cup-shaped body and the housing wall is at the rear of the cup-shaped body.

3. The latch assembly according to claim 2 wherein the cup-shaped body has laterally spaced walls and vertically spaced walls bounding a cup-shaped receptacle and the housing wall opening is midway between the laterally spaced walls.

4. The latch assembly according to claim 1 wherein the housing further comprises first and second spaced, discrete ribs defining first and second spaced edges which are abuttable to an edge on a movable closure to which the latch assembly is operatively mounted.

5. The latch assembly according to claim 4 further comprising a gasket having a projection extending between and interlocked with the first and second ribs to consistently maintain the housing and gasket in a predetermined relative position.

6. The latch assembly according to claim 1 wherein there is a gasket on at least one of the paddle and housing that substantially fully surrounds the housing opening to block the passage of water through the housing opening from the front of the housing wall.

7. The latch assembly according to claim 1 wherein the latch element has a surface for engaging a frame, to which a movable closure on which the latch assembly is mounted, is movably mounted and the surface comprises a plastic material.

8. In combination:

a) a movable closure mounted to a frame for movement relative to the frame between open and closed positions, said movable closure having a front and rear and a peripheral edge between the front and rear of the movable closure; and b) a latch assembly in an operative position on the movable closure, the latch assembly comprising:

a housing having a front, a rear and a wall with a forwardly facing surface, the housing further having laterally spaced walls and vertically spaced walls defining in conjunction with the housing wall with the forwardly facing surface a forwardly opening cup-shaped receptacle; and an actuating assembly that is changeable between first and second states, the actuating assembly including an actuator element that is operable to selectively change the actuating assembly from the first state into the second state, the housing wall with the forwardly facing surface having an opening therethrough to allow the actuating assembly to extend from forwardly of the housing wall with the forwardly facing surface through the opening to rearwardly of the housing wall with the forwardly facing surface and reposition a latch element at the rear of the housing as an incident of the actuating assembly changing from the first state into the second state, the opening being located to be substantially midway both between the laterally spaced housing walls and between the vertically spaced housing walls, the actuating assembly comprising a paddle residing at least partially within the housing receptacle and pivotably connected to the housing for movement around an axis between first and second positions to change the actuating assembly from the first state into the second state, said paddle having a wall with a peripheral edge as viewed from the front of the assembly and spaced edge portions spaced from each other by a first distance along a line that is substantially orthogonal to the axis, the paddle wall having a rearwardly facing surface, said actuator element comprising a cantilevered post which projects rearwardly from the paddle wall at a location spaced from each of the edge portions by a distance at least equal to ¼ of said first distance, the cantilevered post being oriented to project in a direction generally perpendicular to the first wall, there being a space between the peripheral edge of the paddle and the housing so that fingers on a user's hand can move rearwardly into the space and engage the rearwardly facing surface on the paddle wall to draw a part of the paddle forwardly to pivot the paddle from the first position into the second position, said cantilevered post being fixedly connected to the paddle wall, said latch assembly further comprising a latch element that is movable between a latched position and a released position, said cantilevered post driving the latch element from one of the latched and released positions into the other of the latched and released positions as an incident of the paddle moving from the first position into the second position.

9. The combination according to claim 8 wherein the movable closure has a mounting opening therethrough bounded by an edge and the housing has first and second spaced, discrete ribs defining first and second spaced edges which are simultaneously abuttable to the edge of the movable closure bounding the mounting opening with the latch assembly in the operative position to consistently align the latch assembly in the operative position.

10. The combination according to claim 8 wherein the housing has a peripheral flange with a rearwardly facing surface that abuts to the front of the movable closure with the latch assembly in the operative position, there is a gasket disposed between the peripheral housing flange and the front of the movable closure and the gasket has a portion that is complementarily shaped to at least one of the ribs to consistently locate the gasket with respect to the housing.

* * * * *